US008302317B2

(12) United States Patent
Lin

(10) Patent No.: US 8,302,317 B2
(45) Date of Patent: Nov. 6, 2012

(54) SCRAPER STRUCTURE

(76) Inventor: Wen-Chen Lin, Taichung (TW)

( * ) Notice: Subject to any disclaimer, the term of this patent is extended or adjusted under 35 U.S.C. 154(b) by 289 days.

(21) Appl. No.: 12/243,429

(22) Filed: Oct. 1, 2008

(65) Prior Publication Data

US 2010/0077620 A1 Apr. 1, 2010

(51) Int. Cl.
*B26B 3/00* (2006.01)

(52) U.S. Cl. ..... 30/169; 30/344; 15/236.01

(58) Field of Classification Search ..... 30/344, 30/169; 15/236.01, 236.02, 236.07; 83/915.5
See application file for complete search history.

(56) References Cited

U.S. PATENT DOCUMENTS

| | | | | | |
|---|---|---|---|---|---|
| 900,871 | A | * | 10/1908 | McCabe | 403/244 |
| 911,536 | A | * | 2/1909 | Banke | 15/145 |
| 1,434,914 | A | * | 11/1922 | Rhodes | 30/171 |
| 1,854,286 | A | * | 4/1932 | Abrahamsen | 30/138 |
| 2,392,273 | A | * | 1/1946 | Soldani | 30/171 |
| 2,445,140 | A | * | 7/1948 | Hanington | 101/114 |
| 2,494,455 | A | * | 1/1950 | Soldani | 30/171 |
| 2,563,940 | A | * | 8/1951 | Krasberg | 15/105 |
| 3,214,834 | A | * | 11/1965 | Bell | 30/169 |
| 3,363,316 | A | * | 1/1968 | Skarsten | 30/171 |
| 4,542,554 | A | * | 9/1985 | Wallerstein | 15/236.02 |
| 4,690,724 | A | * | 9/1987 | Outlaw | 156/584 |
| 4,700,600 | A | * | 10/1987 | Pickett | 83/165 |
| 5,097,554 | A | * | 3/1992 | McLaughlin | 7/105 |
| 5,208,984 | A | * | 5/1993 | Negus | 30/169 |
| 5,435,064 | A | * | 7/1995 | Brookfield | 30/169 |
| D381,483 | S | * | 7/1997 | Hartman | D32/48 |
| 6,237,225 | B1 | * | 5/2001 | Tarrant | 30/169 |
| 6,351,888 | B1 | * | 3/2002 | Brown et al. | 30/169 |
| 6,568,087 | B1 | * | 5/2003 | Gringer | 30/169 |
| 6,629,331 | B2 | * | 10/2003 | Panfili et al. | 15/236.06 |
| 6,871,377 | B2 | * | 3/2005 | Veltrop et al. | 15/236.01 |
| D584,870 | S | * | 1/2009 | Arvinte et al. | D32/49 |
| D587,871 | S | * | 3/2009 | van Deursen et al. | D32/49 |
| 7,717,067 | B2 | * | 5/2010 | Porter et al. | 119/601 |
| 2002/0095737 | A1 | * | 7/2002 | Panfili et al. | 15/143.1 |

* cited by examiner

*Primary Examiner* — Boyer D Ashley
*Assistant Examiner* — Omar Flores Sanchez

(57) ABSTRACT

The invention relates to a scraper structure, which is generally comprised of a long handle for handgrip and a scraping section in its front. Basically, the scraping section of the scraper is comprised of a jaw plate, a blade, a fastener and a fastening button. The front end of the scraping section extends downward or forward to form a blade slot and has a jaw base at the bottom to connect to the blade slot. The jaw plate has identical shape to the clamp jaw in the front of the jaw base. The fastener and the fastening button are combined to provide tightening and enable the clamp jaw in the front of the jaw plate to exert great pressure onto the blade and achieve quick blade replacement and assembly. Further, the fastening button can exert more force by the front hand in grasping the handle and achieve powerful scraping.

6 Claims, 5 Drawing Sheets

SCRAPER STRUCTURE

BACKGROUND OF THE INVENTION

1. Field of the Invention

The invention relates to a tool to remove the residues on object surface in an improvement and remodeling project. Especially it relates to a scraper structure, which provides primarily quick replacement and stable assembly for scraper blade and further a front handle to facilitate the operation with more power and attain effective cleaning.

2. Description of the Prior Art

To replace wallpaper or carpet in interior remodeling, it is necessary to remove the residual adhesive on objective surface to assure the flatness. Please refer to FIG. 1 and FIG. 2 for the structural disassembly diagram and assembly diagram for a common scraper. The scraper is generally comprised of a long handle 10 for handgrip and a scraping section 11 in its front. The rear end of the scraping section 11 has a connection end 12 for connection with the long handle 10, while the front end has a jaw base 13 and a blade slot 14 for assembly of a clamp jaw 15 and a blade 16. A tightening screw 17 passes through the clamp jaw 15 and the scraping section 11 to facilitate the clamp jaw 15 inside the jaw base 13 to tighten the blade 16 and enable the installation of the blade 16 in the blade slot 14 of the scraping section 11. Thus, a user can grasp the long handle 10 with two hands to remove the residues on object surface by the blade 16 and facilitate replacement work for wallpaper or carpet. With further understanding of the disclosed scraper structure, it is found that the blade assembly structure has the following drawbacks.

First, the tightening mechanism for the clamp jaw 15 inside the jaw base 13 of the scraping section 11 is achieved by passing the screw 17 through the clamp jaw 15 and the scraping section 11. The passing screw 17 needs to be able to exert even tightening force, which is only achievable by at least three screws 17. In other words, it needs to loosen and tighten at least three screws 17 for replacing the blade 16. It is obviously inconvenient.

Second, since the clamp jaw 15 uses the passing screw 17 to achieve tightening the blade 16 and the blade 16 location is very close to the tightening screw 17, when the tightening force by any screw 17 is insufficient, there is a potential risk of the blade 16 jumping off during scraping work and subject to counterforce. It could be an unstable assembly.

Third, the blade 16 is horizontally installed in the front end of the scraping section 11. When a user grasps the long handle with two hands to remove the residues on object surface by the blade 16, the angle between the scraping section 11 and object surface is very small. Therefore, the hand grasping the front end of the long handle 10 becomes very close to the object surface. There is a potential risk of injury to the fingers of the griping hand if caution is not applied.

In view of the above drawbacks for the disclosed scraper structure, seeking improvement is the motivation for the invention.

SUMMARY OF THE INVENTION

Thus, the objective for the invention is to provide a scraper structure that primarily has a jaw groove at the bottom surface of the scraping section of a scraper to connect to the blade slot. In the back end of the jaw groove there is a round hole passing to the top surface of the scraping section. A jaw plate has a clamp jaw in the front and a round hole in the back. When the jaw plate is installed inside the jaw groove at the bottom of the scraping section by a passing fastener, a fastening button is provided at the top surface of the scraping section to be combined with the fastener. This enables tightening force provided to the center of the jaw plate and great pressing force to the blade by the clamp jaw in the front. This will achieve quick replacement and stable assembly for the blade.

Another objective for the invention is to provide a scraper structure, in which the fastening button it uses to combine the fastener can be a spherical object on the top surface of the scraping section, and moreover can assure safe and firm grip by the front hand of a user to achieve powerful scraping and cleaning.

To achieve the above objectives, a scraper structure is provided in the invention and mainly comprised of a long handle and a scraping section. The scraping section is coupled with the front of the long handle. The front end of the scraping section extends downward or forward to form a blade slot, while its bottom has a jaw groove to connect to the blade slot. A round hole on the inner rear side of the jaw groove is provided to pass through to the top of the scraping section. Associated with the round hole there is a square groove on the inner side of the jaw groove. A jaw plate with similar shape to the jaw groove of the scraping section has a clamp jaw in the front to match the orientation of the blade slot, while in the rear end there is a square hole. The jaw plate is installed inside the jaw groove of the scraping section by a passing fastener. When a fastening button on the top of the scraping section is combined with the fastener, the fastener can provide tightening force with the jaw plate aiming the rear end and allows the clamp jaw in the front to exert a huge pressure onto the blade. This also enables firm lock of the blade into the blades lot of the scraping section. On the other hand, if the fastening button is loosened, the fastener will lose tightening force and quick replacement of blade will be achievable. In the rear end of the long handle a grip is provided for the user to grasp and exert force. Inside the grip, there is a turn cap and a chamber for storing the blade and facilitating replacement.

DETAILED DESCRIPTION OF THE PREFERRED EMBODIMENT

The following describes the features for the invention with a preferred embodiment and figures.

Please refer to FIG. 3, FIG. 4 and FIG. 5 for the structural disassembly diagram and assembly diagram for the scraper in the invention. The scraper is generally comprised of a long handle 20 for handgrip and a scraping section 30 in its front.

The long handle 20 has a grip 21 in the rear end and outer side for handgrip, which inside contains a chamber 22 and a turn cap 23 for storing the blade 32 and facilitating replacement. Its front end has a connection groove 24 that can be assembled with the rear end coupler 301 of the scraping section 30.

The scraping section 30 is comprised of a jaw plate 31, a blade 32, a fastener 33 and a fastening button 34. The front end of the scraping section extends downward to form a blade slot 35, which inner side has two connection pins 351 at predetermined locations. At the corresponding locations on the blade 32 there are two connection holes 321. The assembly of blade 32 can be assured by locking the two connection holes 321 and the two connection pins 351 on the blade slot 35. The blade 32 sticks out of the bottom of the blade slot 35. At the bottom surface of the scraping section 30 there is a jaw groove 36 to connect to the blade slot 35. A round hole 37 in the rear end of the jaw groove 36 extends to the top. Associated with the round hole 37 there is a square groove 371 on the inner side of the jaw groove 36. On the top surface of the scraping section 30 there is a circular groove 372. The shape of the jaw plate 31 is similar to that of the jaw groove 36 of the scraping section 30. Its front end has a clamp jaw 38 to match the orientation of the blade slot 35. The downward angle for the clamp jaw 38 is slightly larger than that for the blade slot 35. The rear end has a square hole 39. A fastener 33 containing a retaining ring 40, a square restriction block 41 and a screw thread 42 passes through the square hole 39 of the jaw plate 31 and the round hole 37 of the scraping section 30 with screw thread 42. Thus the retaining ring 40 pushes against the back of the jaw plate 31. Besides, the square restriction block 41 passes between the square hole 39 of the jaw plate 31 and the square groove 371 in the inner side of the jaw groove 36 of the scraping section 30 and cannot be turned. Inside the fastening button 34, there is a molded cap nut 43. On the top of the scraping section 30 the fastening button 34 can connect with the screw thread 42 of the fastener 33 with the cap nut 43 and provides tightening to the center of the jaw plate 31. With a larger downward angle for the clamp jaw 38 than that for the blade slot 35, this also enables a great pressure for the clamp jaw 38 in the front of the jaw plate 31 to exert onto the blade 32. As a result, a sound and firm assembly is provided to the blade 32. On the other hand, by simply loosening the fastening button 34 gently to relax the jaw plate 31, the blade 32 can be removed or replaced to achieve quick replacement purpose. Since the fastening button 34 can use the bottom of the cap nut 43 to push against the circular groove 372 on the top of the scraping section 30, the tightening with the fastener 33 actually enables the user to exert more force by the front hand in grasping the handle and achieve powerful scraping as well as a safe gesture for the user to operate the tool.

Please refer to FIG. 4 for another embodiment for the jaw plate for the invention. The jaw plate 31 is located at the side of the square hole 39 and can be equipped with ribs 311 extendable to the front clamp jaw 38. The purpose is to enhance the grip of the blade 32 by the clamp jaw 38 and strengthen the assembly in the blade slot 35.

Please refer to FIG. 6 for another embodiment of the scraping section for the invention. The blade slot 35 extended from the scraping section can be forwardly oriented to facilitate the scraping by the blade 32 in the assembly.

The above disclosed figures and description is merely preferred embodiments for the invention. The alteration or modification by those familiar with the arts and techniques, for example, using wedge or cam or any mechanism to generate vertical tension as the fastener inside the jaw groove of the scraping section, or changing the orientation of the blade slot in the front of the scraping section, is not limited by the invention and shall be covered within the range of claims by the invention.

Specific Drawing:

The designated diagram for the present invention is FIG. 3.

(2) The legends for the components

| | | | | | |
|---|---|---|---|---|---|
| 30 | scraping section | 301 | coupler | 31 | jaw plate |
| 32 | blade | 321 | connection hole | 33 | fastener |
| 34 | fastening button | 35 | blade slot | 351 | connection pin |
| 36 | jaw groove | 37 | round hole | 371 | square groove |
| 38 | clamp jaw | 39 | square hole | 40 | retaining ring |
| 41 | square restriction block | 42 | screw thread | 43 | cap nut |

DESCRIPTION OF MAIN COMPONENTS

Figure 1:
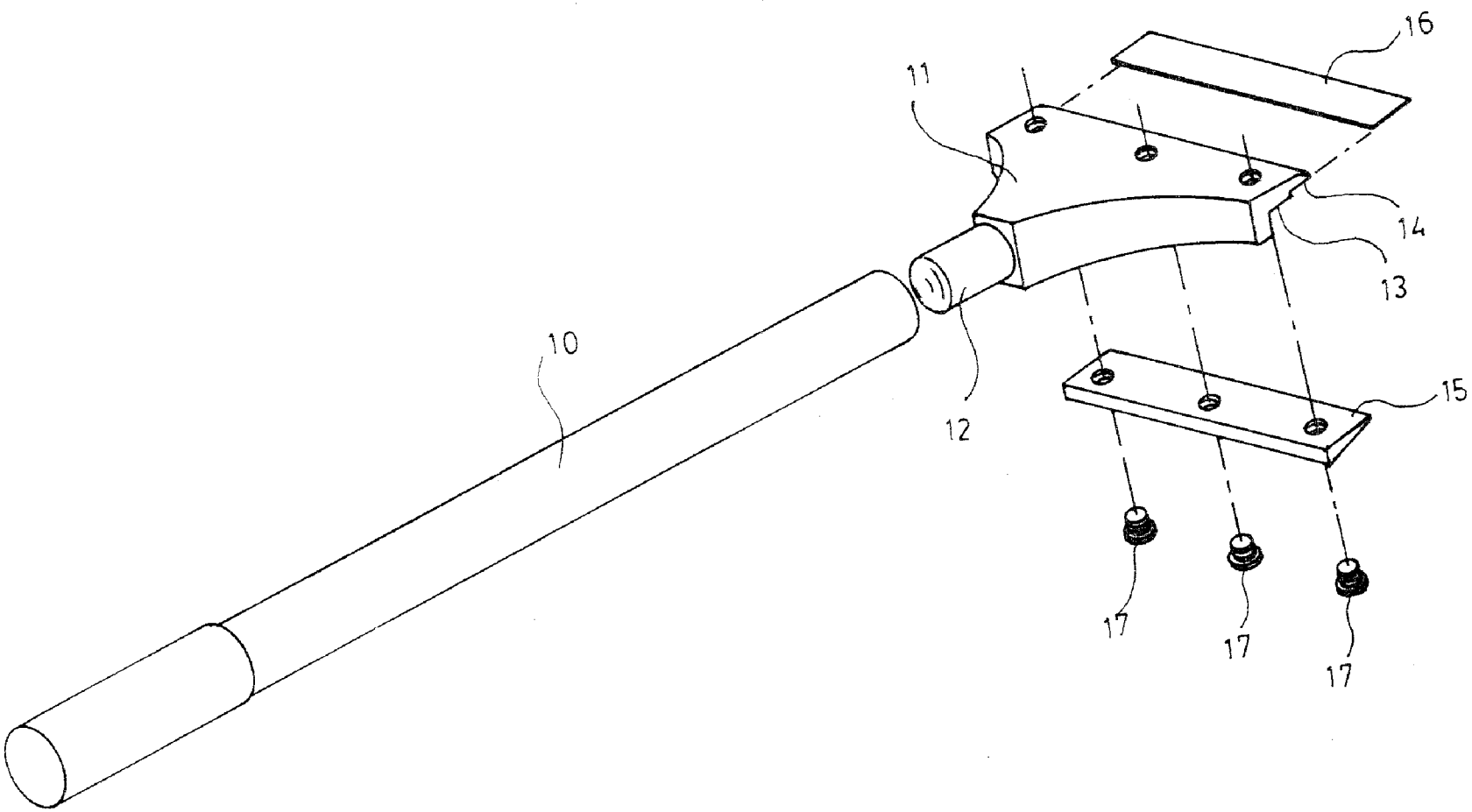
Fig. 1 PRIOR ART
FIG. 1 is a disassembly diagram for a common scraper structure.
Figure 2:
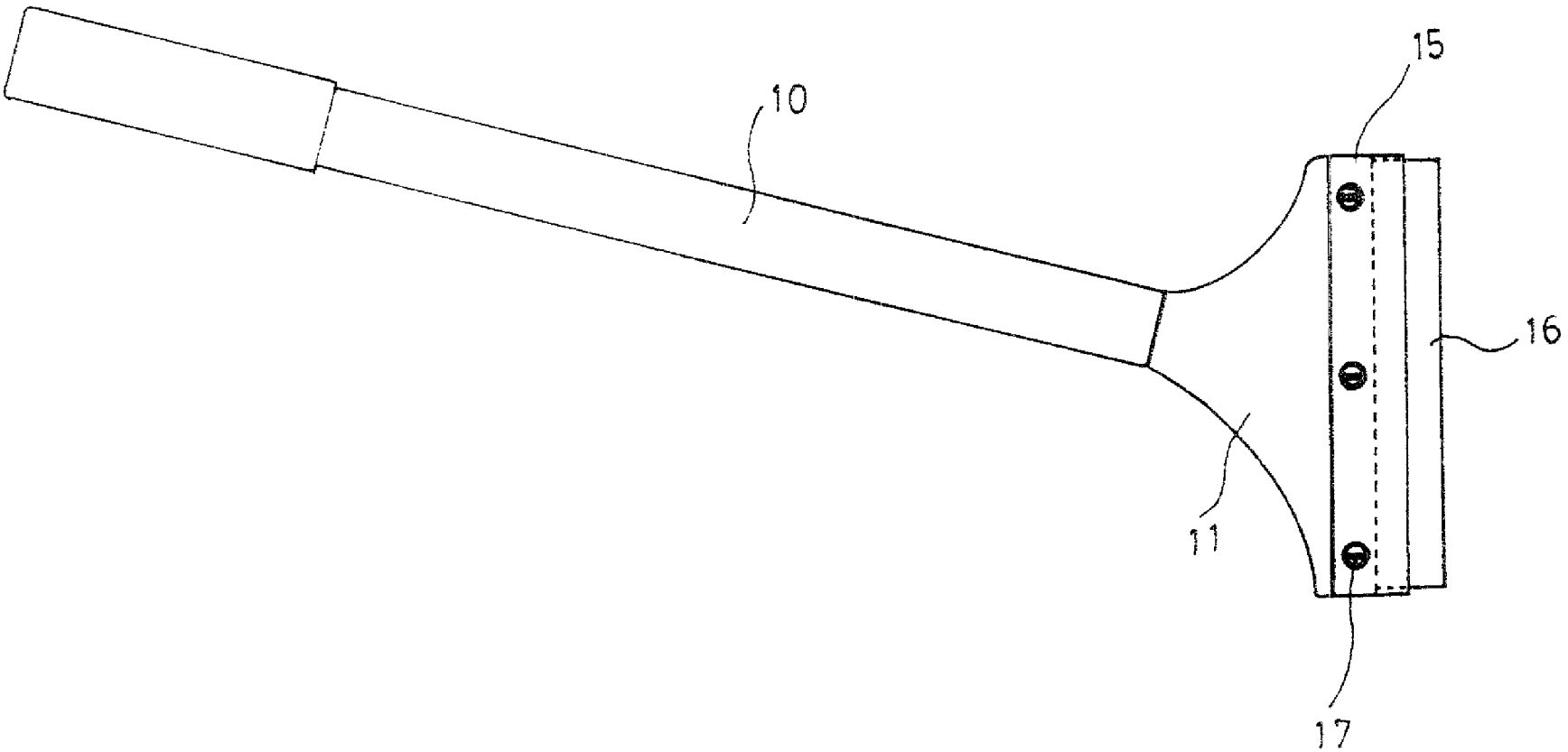
Fig. 2 PRIOR ART
FIG. 2 is an assembly diagram for the object in FIG. 1.
Figure 3:
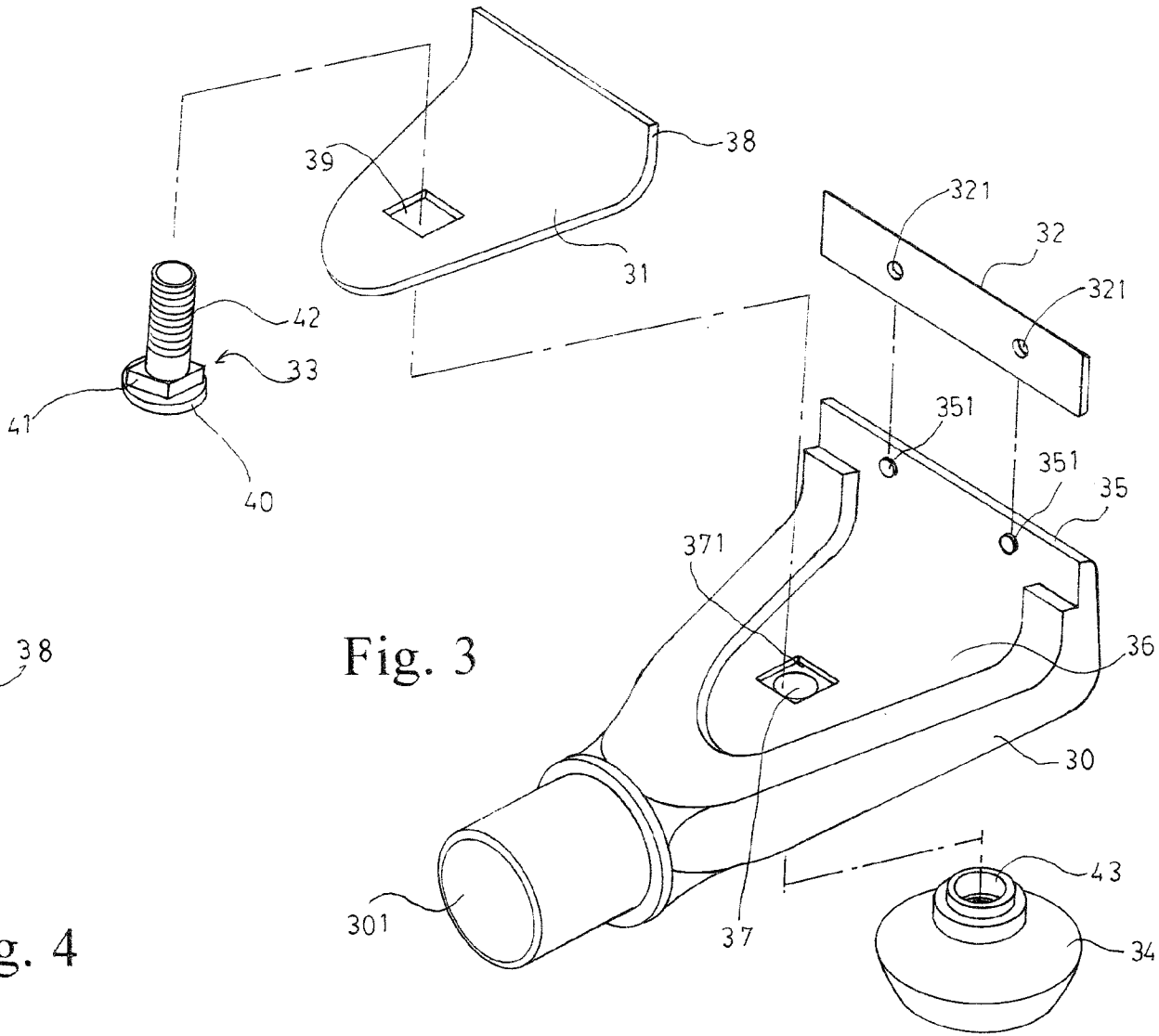
FIG. 3 is a disassembly diagram for the scraping section for the scraper structure for the invention.
Figure 4:
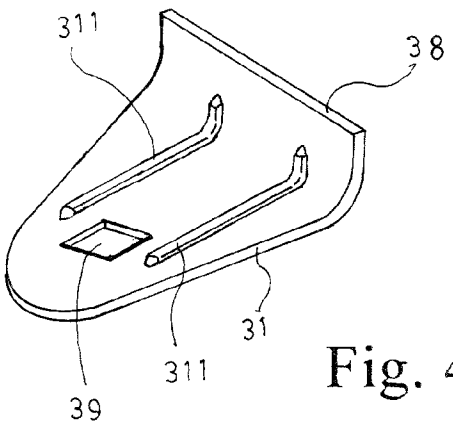
FIG. 4 is another embodiment for the jaw plate for the invention.
Figure 5:
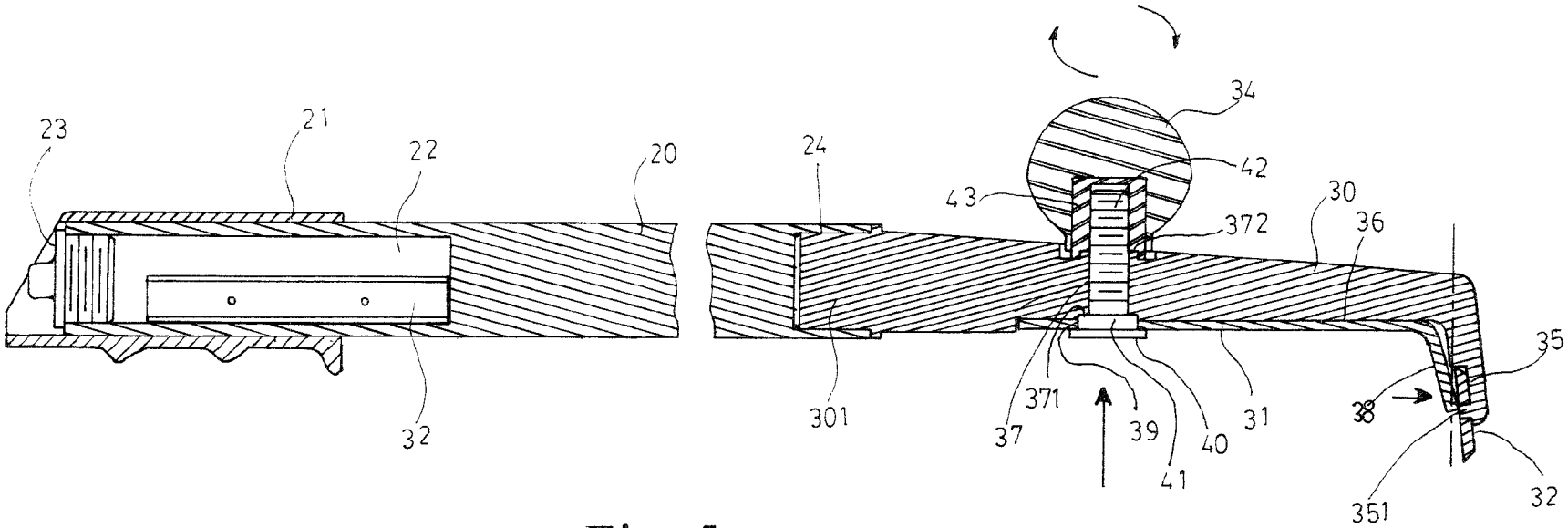
FIG. 5 is a cross-sectional diagram for the assembly of the scraper for the invention.
Figure 6:
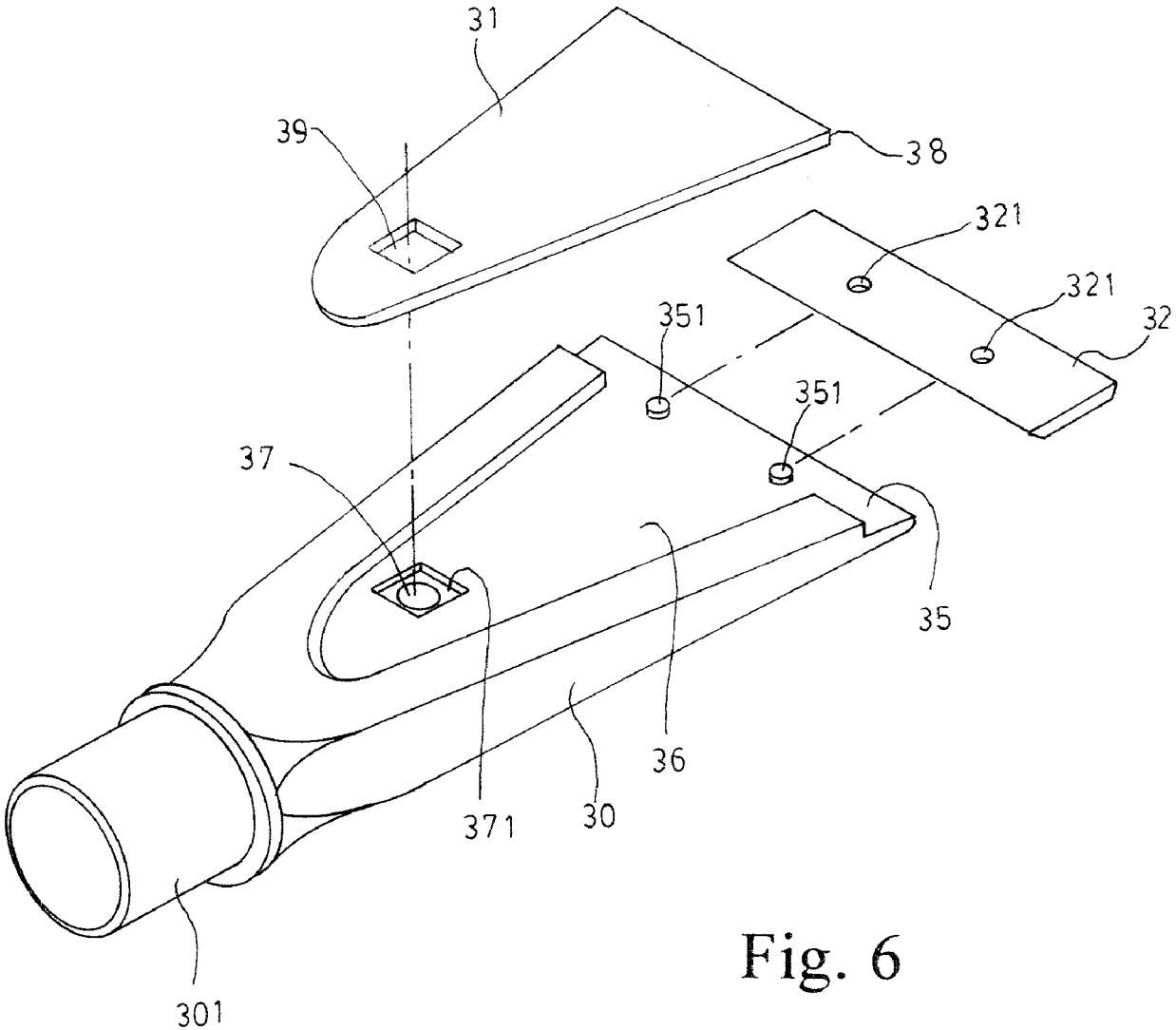
FIG. 6 is the scraping section for another embodiment.

| | | | | | |
|---|---|---|---|---|---|
| 10 | long handle | 11 | scraping section | 12 | connection end |
| 13 | jaw base | 14 | blade slot | 15 | clamp jaw |
| 16 | blade | 17 | screw | 20 | long handle |
| 21 | grip | 22 | chamber | 23 | turn cap |
| 24 | connection groove | 30 | scraping section | 301 | coupler |
| 31 | jaw plate | 311 | rib | 32 | blade |
| 321 | connection hole | 33 | fastener | 34 | fastening button |
| 35 | blade slot | 351 | connection pin | 36 | jaw groove |
| 37 | round hole | 371 | square groove | 372 | circular groove |
| 38 | clamp jaw | 39 | square hole | 40 | retaining ring |
| 41 | square restriction block | 42 | screw thread | 43 | cap nut |

What is claimed is:

1. A scraper structure, comprising:

a handle for a handgrip; and a tapered scraping section positioned at a front end of the handle, the scraping section tapering towards the front end of the handle, and an opposing end terminating in an L-shape;

wherein the handle has a grip opposite the scraping section and a connection groove in the front end configured to assemble with a coupler at a rear end of the scraping section, wherein the tapered L-shaped scraping section further including an L-shaped jaw plate, a blade, a fastener and a fastening button, the L-shaped scraping section formed by a front end of the scraping section extending downward to form a substantially planar blade slot having an inner surface with a plurality of connection pins and a jaw groove connected to the blade slot on a bottom surface of the scraping section and angled with respect to the blade slot, the blade configured to fit into the blade slot and including a plurality of corresponding connection holes to the plurality of connection pins on the blade slot, such that the holes and the pins lock to each other for assembly, a round hole located at a rear end of the jaw groove, and extending to a top of the jaw groove, and associated with the round hole is a square groove on an inner side of the jaw groove, the scraping section also including a circular groove on a top surface of the scraping section, the jaw plate fitting within the jaw groove, wherein a front of the jaw plate includes a clamp jaw to match an orientation of the blade slot, the clamp jaw forming an angle with a main surface of the jaw plate that is greater than the angle formed between the blade slot and the jaw groove, so that the clamp jaw presses onto the blade inside the blade slot, and a rear end of the jaw plate includes a square hole, the fastener including a retaining ring, a square restriction block and a screw thread, wherein the screw thread passes through the square hole of the jaw plate and the round hole of the scraping section, the fastening button including a molded cap nut, wherein the fastening button is combined with the screw thread of the fastener by the cap nut on the top surface of the scraping section to restrict the jaw plate and the jaw groove assembly of the scraping section and to provide a tightening force to enable the clamp jaw in the front of the jaw plate to exert onto the blade.

2. The scraper structure according to claim 1, wherein the fastener uses the retaining ring to push against the back of the jaw plate and uses the square restriction block to pass between the square hole of the jaw plate and the square groove in the inner side of the jaw groove of the scraping section.

3. The scraper structure according to claim 1, wherein the jaw plate is located on a side of the square hole and has ribs extending to the front of the clamp jaw to enhance a grip of the blade by the clamp jaw and strengthen the assembly in the blade slot.

4. The scraper structure according to claim 1, wherein the fastening button uses a bottom of the cap nut to push against the circular groove on the top of the scraping section.

5. The scraper structure according to claim 1, wherein the fastening button includes a ball-shape to facilitate the assembly of the jaw plate inside the jaw groove at the bottom of the scraping section and sticks out of the top of the scraping section to allow a user to grasp the front of the scraper structure.

6. The scraper structure according to claim 1, wherein the rear end of the long handle includes a chamber and a turn cap to store the blade.

* * * * *